US005798327A

United States Patent [19]

Casteleijn et al.

[11] Patent Number: 5,798,327

[45] Date of Patent: Aug. 25, 1998

[54] ENZYMATIC DETERGENT COMPOSITIONS

[75] Inventors: Eric Casteleijn, Vlaardingen; Willem R. van Dijk, Oud Beijerland; Jan Klugkist; Pieter Dirk van Wassenaar, both of Vlaardingen, all of Netherlands

[73] Assignee: Lever Brothers Company, New York, N.Y.

[21] Appl. No.: 752,108

[22] Filed: Nov. 20, 1996

[30] Foreign Application Priority Data

Nov. 27, 1995 [EP] European Pat. Off. ..... 95203261

[51] Int. Cl.[6] ..... C11D 3/386; C11D 3/395

[52] U.S. Cl. ..... 510/303; 510/305; 510/306; 510/320; 510/321; 510/372; 510/375; 510/378; 510/397; 510/393; 510/530; 435/209

[58] Field of Search ..... 510/392, 393, 510/320, 321, 530, 303, 305, 306, 372, 375, 378; 435/209

[56] References Cited

U.S. PATENT DOCUMENTS 5,501,820 3/1996 van den Bergh et al. ..... 252/549
5,677,151 10/1997 Wilson et al. ..... 435/72

FOREIGN PATENT DOCUMENTS

89/09259 10/1989 WIPO .
91/17243 11/1991 WIPO .
92/18599 10/1992 WIPO .
94/07998 4/1994 WIPO .
94/21801 9/1994 WIPO .
94/28117 12/1994 WIPO .
95/24471 9/1995 WIPO .
97/20025 6/1997 WIPO .
97/20026 6/1997 WIPO .

OTHER PUBLICATIONS

Henrissat et al., Biochemical Journal 293: pp. 781–788 (1993).
Lao et al. Journal of Bacteriology, 173; pp. 3397–3407 (1991.
McGinnis et al., Biochemistry, 32, pp. 8157–8161 (1993).
International Search Report dated Mar. 14, 1997.
Lau, et al "DNA Sequence of Three β-/-4-Endoglucamase Genes from *Thermomonospora fusca" Journal of Bacteriology* vol. 173 No. 11, pp. 3397–3407 (1991).
McGinnis "Disulfide Arrangement and Functional Domains of β-/-4-Endoglucamase E5 from *Thermomonospora fusca" Biochemistry,* vol. 32 pp. 8157–8161 (1993.

*Primary Examiner*—Kery Fries
*Attorney, Agent, or Firm*—Rimma Mitelman

[57] ABSTRACT

There is provided an enzymatic detergent composition comprising a surfactant and an endoglucanase producible from *Thermomonospora fusca,* preferably E5, or mutants or variants thereof.

3 Claims, No Drawings

ENZYMATIC DETERGENT COMPOSITIONS

TECHNICAL FIELD

The present invention generally relates to the field of enzymatic detergent and cleaning compositions. More in particular, the invention is concerned with enzymatic detergent compositions for fabric washing and comprising an endoglucanase.

BACKGROUND AND PRIOR ART

Various types of enzymes are known in the art as additives for detergent compositions. For example, detergent compositions containing proteases, lipases, amylases and cellulases and various combinations thereof have been described in the literature and several such products are currently on the market. Of these enzymes, proteases, lipases and amylases are most abundantly used. The enzymes assist in the cleaning of fabrics by degrading their natural substrates protein, fat and starch. Cellulase, on the other hand, is not added to detergent products because of its capability to break down cellulose, but rather to attain certain "care" benefits such as colour clarification, anti-pilling and reduction of the harshness of the fabric.

The harshness-reducing action of cellulase in detergent compositions was first described GB-A-1 368 599 (Unilever). DE-A-3 207 847 (Kao) discloses that the addition of cellulase to a detergent product improves its cleaning performance. EP-A-220 016 (Novo Nordisk) describes a colour clarification activity of cellulases.

Cellulases occur in nature as very complex mixtures of enzymes and in recent years several attempt have been described to isolate its various components and to produce them by means of recombinant DNA techniques. For a classification of cellulases, see Henrissat and Bairoch, Biochemical Journal 293, 781–788 (1993). A special class of cellulases, the endoglucanases, have been described as particularly useful for detergent applications.

WO-A-89/09259 (Novo Nordisk) discloses a cellulase preparation useful for reducing the harshness of cotton-containing fabrics, comprising at least 40% of an endoglucanase component with a high endoase activity and affinity towards cellulose. WO-A-91/17243 (Novo Nordisk) discloses a cellulase preparation consisting essentially of a homogeneous endoglucanase which is immunoreactive with or homologous to a 43 kD endoglucanase derived from *Humicola insolens* DSM 1800. The pH optimum of the endoglucanase from *Humicola insolens* DSM 1800 is about 8. WO-A-94/21801 (Genencor) discloses the production and purification of endoglucanase EGIII from *Trichoderma longibrachiatum*. This endoglucanase is said to have a pH optimum of 5.5–6.0.

Although several of these endoglucanases have been reported to have favourable properties in detergent products, there is still a need to provide alternative or improved endoglucanase containing detergent compositions. In particular, the storage stability of endoglucanases, as well as their stability in the presence of proteolytic enzymes and or bleach leaves to be desired, especially in liquid detergent formulations.

For instance, it was found that the activity of the of Endoglucanase III from *Trichoderma longibrachiatum*, which has a pH optimum of 5.5–6.0, is rapidly decreasing in the alkaline region. Thus, there is also a particular need for endoglucanase containing detergent compositions which exhibit typical cellulase-associated benefits at alkaline pH.

It is therefor an object of the present invention to provide a detergent composition for fabric washing, containing an endoglucanase that is stable in (liquid) detergents during storage, in particular in the presence of proteolytic enzymes and or bleach. It is a further object of the present invention to provide a detergent composition containing an endoglucanase that is effective at alkaline pH.

We have now surprisingly found that these and other objects can be achieved by the detergent compositions of the invention which are characterized in that the cellulase is an endoglucanase producible from *Thermomonospora fusca*, preferably endoglucanase E5, or mutants or variants thereof.

In particular, such endoglucanases can be used to formulate detergent compositions which are stable and exhibit anti-pilling and colour clarification properties, even at alkaline pH and in the presence of proteolytic enzyme and or bleach. We have also found that such endoglucanases do not depend on special proteases for stability, such as described in WO-A-92/18599 (Novo Nordisk) for the 43 kD endoglucanase derived from *Humicola insolens* DSM 1800.

DEFINITION OF THE INVENTION

According to a first aspect of the invention, there is provided an enzymatic detergent composition comprising a surfactant and an endoglucanase producible from *Thermomonospora fusca*, or mutants or variants thereof.

According to a second aspect, the enzymatic detergent composition additionally comprises a proteolytic enzyme and or bleach.

DESCRIPTION OF THE INVENTION

The detergent composition of the present invention comprises one or more surface active ingredients or surfactants and an endoglucanase producible from *Thermomonospora fusca*, preferably endoglucanase E5, or mutants or variants thereof. The detergent compositions containing the special endoglucanases of the invention may be in any suitable physical form, such as a powder, an aqueous or non-aqueous liquid, a paste or a gel. However, aqueous liquid detergents and highly alkaline powders are preferred. The storage stability of the special endoglucanase of the invention in isotropic liquid detergents was found to be exceptionally good. For liquid detergents, the pH of a solution of 1 gram of the detergent composition in 1 liter of water, with a hardness of 10° German before the addition of the detergent composition, at 20° C., is in the range of 7 to 11, preferably in the pH range of 8 to 10.5, more preferably 9 to 10.2.

(a) The surfactant

The compositions of the invention comprise, as a first ingredient, one or more surface active ingredients or surfactants. Depending on the physical type of detergent, the surfactants are present in an amount of 0.1–60% by weight of the composition. Typically, an aqueous liquid detergent composition comprises from 5% to 50%, commonly at least 10% and up to 40%, by weight of one or more surface-active compounds. Fabric washing powders usually comprise from 20% to 45% by weight of one or more detergent-active compounds.

The compositions may comprise a single type of surfactant, mostly nonionics, but usually they contain a surfactant system consisting of 30–70% by weight (of the system) of one or more anionic surfactants and 70–30% by weight (of the system) of one or more nonionic surfactants. The surfactant system may additionally contain amphoteric or zwitterionic detergent compounds, but this in not normally desired owing to their relatively high cost.

In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$–$C_{22}$ alkyl phenol-ethylene oxide condensates, generally 5 to 25 EO, i.e. 5 to 25 units of ethylene oxide per molecule, and the condensation products of aliphatic $C_8$–$C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$–$C_{18}$ alcohols, produced for example from tallow or coconut oil, sodium and potassium alkyl $C_9$–$C_{20}$ benzene sulphonates, particularly sodium linear secondary alkyl $C_{10}$–$C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$–$C_5$ alkyl benzene sulphonates and sodium $C_{12}$–$C_8$ alkyl sulphates.

Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system which is a mixture of an alkali metal salt of a $C_{16}$–$C_{18}$ primary alcohol sulphate together with a $C_{12}$–$C_{15}$ primary alcohol containing 3–7 ethoxylate groups.

(b) The enzyme

The compositions of the invention further comprise, as a second ingredient, a specific endoglucanase enzyme which is producible from *Thermomonospora fusca*, or mutants or variants thereof. This soil bacterium produces six different cellulases which are referred to in the literature as E1 to E6. All six enzymes contain a cellulose binding domain ("cbd") joined to the catalytic domain ("cd") by means of a flexible linker. Three of the cellulases are endoglucanases ( E1, , E2 and E5), two are exocellulases (E3 and E6) and one (E4) is an exocellulase with some endoglucanase activity. These specific enzymes and their production by means of recombinant DNA techniques have been described in the literature, see e.g. by Loa et al. Journal of Bacteriology (1991) 173, 3397–3407. Using modern recombinant DNA techniques, the skilled man will have no difficulties in preparing these enzymes or mutants or variants of these enzymes.

In the context of the present invention, "mutants or variants" of *Thermomonospora fusca* endoglucanases are defined as endoglucanase enzymes which closely resemble the naturally occurring *Thermomonospora fusca* endoglucanases, but are different in one or more amino acids, e.g. by substitution, deletion or insertion of one more amino acids. They will exhibit a high degree of homology (in terms of identity of residues) of at least 70%, preferably at least 80% or 90% or even 95% with the naturally occurring *Thermomonospora fusca* endoglucanase.

Another way of defining "homology" is, that DNA encoding the variant or mutant endoglucanase will hybridize to the same probe as the DNA coding for the naturally occurring *Thermomonospora fusca* endoglucanase, under certain specified conditions (i.e. presoaking in 5×SSC and prehybridizing for 1 hour at 40° C. in a solution of 20% formamide, 5×Denhard't solution, 50 mM sodium phosphate, pH 6.8 and 50 ug of denaturated calf thymus DNA, followed by hybridization in the same solution supplemented with ATp for 18 hours at 40° C.).

The enzymatic detergent compositions of the invention may contain an intact *Thermomonospora fusca* endoglucanase, and preferably this is E5. However, they may also contain partially degraded endoglucanase or even the isolated catalytic domain, indicated hereafter by "E5cd", as long as the enzyme still retains its endoglucanase activity.

The enzymatic detergent compositions of the invention comprise about 0.001 to 10 milligrams of the specific active endoglucanase protein per gram of detergent composition. preferably, they comprise 0.001 to 0.2 milligrams of active endoglucanase protein per gram of detergent composition, more preferably 0.005 to 0.04 milligrams per gram. More conveniently, the active cellulase content is measured as enzyme activity on carboxymethyl cellulose (CMC). Expressed in CMC units, the compositions contain 0.06–600 CMCU per gram of detergent composition, preferably 0.06–12.5 CMCU per gram, and more preferably 0.3–2.5 CMCU/gram. In this specification the CMCU or carboxymethyl cellulose unit is measured according to the following protocol. The substrate used is a sodium salt of carboxymethylcellulose (CMC medium viscosity, Sigma catalogue number C4888). The CMC solution is stirred overnight or heated for 30 minutes at 70° C. to dissolve completely in 0.2M sodium phosphate pH 7.0. 0.8 ml of the CMC solution is incubated with 0.2 ml enzyme/wash solution for 30 minutes at 40° C. Then the reaction is stopped by addition of 3 ml pahBah reagent (see below) and the amount of reducing sugars is measured (Lever, 1972) Analytical Biochemistry 47, 273–279. For the pahBah reagent 5 gram para-hydroxy-benzoic acid hydrazide (Sigma catalogue number H9882) is dissolved in 100 ml 0.5N HCl and diluted with 400 ml 0.5N NaOH prior to use. A calibration curve is prepared by dissolving 0, 10, 20, 30 and 40 μg/ml glucose in 0.2M sodium phosphate pH 7.0. One ml of each glucose standard solution as well as 1 ml of the sample solutions (+CMC) is mixed with 3 ml of the pahBah reagent. All mixtures are kept at 98° C. for 5 minutes and then cooled (in water with ice). After cooling to room temperature the light absorbance is spectrophotometrically measured at 405 nm. A calibration curve is obtained by plotting the amount of sugar against the OD405. The amount of sugars formed in the samples is then read from the curve and recalculated in to pmoles of glucose formed per minute (CMCU). The activity is expressed as CMCU per gram of detergent composition or as CMCU per gram of enzyme protein (CMCU/g). Alternatively, it can be expressed as relative figure comparing residual activity to the activity that was originally added (CMCU %).

The endoglucanase of the present invention can usefully be added to the detergent composition in any suitable form, i.e. the form of a granular composition, a liquid or a slurry of the enzyme, or with carrier material (e.g. as in EP-A-258 068 and the Savinase (™) and Lipolase (™) products of Novo Nordisk). A good way of adding the enzyme to a liquid detergent product is in the form of a slurry containing 0.5 to 50% by weight of the enzyme in a ethoxylated alcohol nonionic surfactant, such as described in EP-A-450 702 (Unilever).

(c) Other ingredients.

The enzymatic detergent composition of the present invention may further contain from 5–60%, preferably from 20–50% by weight of a detergency builder. This detergency builder may be any material capable of reducing the level of free calcium ions in the wash liquor and will preferably provide the composition with other beneficial properties such as the generation of an alkaline pH, the suspension of soil removed from the fabric and the suspension of the fabric-softening clay material.

Examples of detergency builders include precipitating builders such as the alkali metal carbonates, bicarbonates, orthophosphates, sequestering builders such as the alkali metal tripolyphosphates, alkali metal citrates or nitrilotriacetates, or ion exchange builders such as the amorphous alkali metal aluminosilicates or the zeolites.

It was found to be especially favourable for the enzyme activity of the detergent compositions of the present invention if they contained a builder material such that the free calcium concentration is reduced to less than 1 mM.

The enzymatic detergent compositions of present invention may also comprise, in further embodiments, combinations with other enzymes and other constituents normally used in detergent systems, including additives for detergent compositions. Such other components can be any of many known kinds, for example enzyme stabilizers, lather boosters, soil-suspending agents, soil-release polymers, hydrotropes, corrosion inhibitors, dyes, perfumes, silicates, optical brighteners, suds depressants, germicides, anti-tarnishing agents, opacifiers, fabric softening agents, oxygen-liberating bleaches such as hydrogen peroxide or sodium perborate, or sodium percarbonate, diperisophthalic anhydride, bleach precursors, oxygen-activating bleaches, buffers and the like.

Examples are described in GB-A-1 372 034 (Unilever), U.S. Pat. No. 3,950,277, U.S. Pat. No. 4,011,169, EP-A-179 533 (Procter & Gamble), EP-A-205 208 and EP-A-206 390 (Unilever), JP-A-63-078000 (1988), and Research Disclosure 29056 of June 1988. The formulation of detergent compositions according to the invention can be also illustrated by reference to the Examples D1 to D14 of EP-A-407 225 (Unilever).

Special advantage may be gained in such detergent compositions wherein a proteolytic enzyme or protease is also present. proteases for use together with the endoglucanase can in certain circumstances include subtilisins of, for example, BPN' type or of many of the types of subtilisin disclosed in the literature, some of which have already been proposed for detergents use, e.g. mutant proteases as described in for example EP-A-130 756 or EP-A-251 446 (both Genentech), U.S. Pat. No. 4,760,025 (Genencor), EP-A-214 435 (Henkel), WO-A-87 04661 (Amgen), WO-A-87/05050 (Genex), Thomas et al. (1986) in Nature 5, 316, and 5, 375–376 and in J. Mol. Biol. (1987) 193, 803–813, Russel et al. (1987) in Nature 328, 496–500, and others.

Furthermore, certain polymeric materials such as polyvinyl pyrrolidones typically having a MW of 5,000 to about 30,000 are useful ingredients for preventing the transfer of labile dye stuffs between fabrics during the washing process. Especially preferred are ingredients which also provide colour care benefits. Examples hereof are polyamide-N-oxide containing polymers. Also envisaged is the addition of peroxidase enzyme in combination with hydrogen peroxide and so-called enhancing intermediates. Finally, cellulases in general are said to provide a soil-release benefit in the wash and the present endoglucanases are no exception.

The invention will now be further illustrated in the following Examples.

EXAMPLE 1

Stability of endoglucanases in wash solutions.

The in-wash stability of endoglucanases according to the invention was compared with several prior art cellulases under the following conditions:

Enzymes

Endoglucanases E5 and E5cd from *Thermomonospora fusca* were obtained from prof. D. B. Wilson, Cornell University, 458 Biotechnology Building, Ithaca N.Y., U.S.A. Both samples were substantially pure as measured by SDS polyacrylamide gel electrophoresis. The catalytic domain E5cd started with amino acid Gly97, as published in Biochemistry 32, 8157–8161 (1993).

KAC-500 is a commercial endoglucanase ex. Kao produced by Bacillus sp. KSM-635 (Ozaki et al., J. of Gen. Microbiology 136, 1327–1334 (1990) and Ito et al. Agric. Biol. Chem. 53, 1275–1281 (1989)).

EGIII endoglucanase is a cellulase ex. Genencor International Inc. produced by *Trichoderma longibrachiatum* and described in WO-A-94/21801 (Genencor).

Celluzyme is a commercial cellulase preparation ex. Novo Nordisk A/S produced by *Humicola insolens* DSM 1800 and described in U.S. Pat. No. 4,435,307.

Cytolase 123 is a commercial cellulase preparation ex. Genencor International produced by *Trichoderma longibrachiatum*.

Detergents

Detergent A=Liquid detergent without enzymes (pH 8):

| Component | % (w/w) |
|---|---|
| NaOH | 0.93 |
| KOH | 4.12 |
| Citric acid (monohydrate) | 5.5 |
| Propylene Glycol | 0.8 |
| Glycerol | 5.00 |
| Borax | 3.50 |
| Polymer Narlex DC1 | 1.00 |
| Nonionic.7EO (Synperonic A7) | 18.4 |
| Priolene 6907 | 10.0 |
| Lialet 123 PAS | 10.0 |
| PVP | 0.5 |
| Perfume | <1.0 |
| Antifoam | <0.5 |
| Dye | <0.5 |
| Water | up to 100% |

Detergent B=powder detergent (pH 10.1):

| Component | % (w/w) |
|---|---|
| Linear PAS (Na salt of Coco alcohol derived sulphate) | 6.37 |
| Nonionic.3EO (Synperonic A3) | 8.05 |
| Nonionic.7EO (Synperonic A7) | 6.37 |
| Soap | 2.25 |
| Zeolite A24 | 38.84 |
| Sodium carbonate | 1.27 |

-continued

| Component | % (w/w) |
|---|---|
| Dequest 2047 | 1.43 |
| Sodium citrate 2 aq. | 23.47 |
| Antifoam granule | 3.15 |
| Water/salts | up to 100% |

Experimental

The experiments are carried out in a two liter thermostatted vessel, containing 1 liter of artificially hardened water (16° FH., prepared with $CaCl_2$, $MgCl_2$, Ca:Mg ratio 4:1). When the water reaches a temperature of 40° C. the detergent is added to a concentration of 4 g/l. The cellulase is dosed after 5 minutes at a concentration of 8 mg enzyme protein per liter. Immediately after mixing a sample is taken (t=1). Between t=1 and t=40 minutes samples are taken and measured for residual cellulase activity.

Activity measurements

The substrate used is a sodium salt of carboxymethylcellulose (CMC medium viscosity, Sigma catalogue number C4888). The CMC solution is stirred overnight or heated for 30 minutes at 70° C. to dissolve completely in 0.2M sodium phosphate pH 7.0. 0.8 ml of the CMC solution is incubated with 0.2 ml enzyme wash solution for 30 minutes at 40° C. Then the reaction is stopped by addition of 3 ml pahBah reagent (see below) and the amount of reducing sugars is measured (Lever, 1972) Analytical Biochemistry 47, 273–279). For the pahBah reagent 5 gram para-hydroxybenzoic acid hydrazide (Sigma catalogue number H9882) is dissolved in 100 ml 0.5N HCl and diluted with 400 ml 0.5N NaOH prior to use. A calibration curve is prepared by dissolving 0, 10, 20, 30 and 40 μg/ml glucose in 0.2M sodium phosphate pH 7.0. One ml of each glucose standard solution as well as 1 ml of the sample solutions (+CMC) is mixed with 3 ml of the pahBah reagent. All mixtures are kept at 98° C. for 5 minutes and then cooled (in water with ice). After cooling to room temperature the light absorbance is measured spectrophotometrically at 405 nm. A calibration curve is obtained by plotting the amount of sugar against the OD405. The amount of sugars formed in the samples is then read from the curve and recalculated in to μmoles of glucose formed per minute (CMCU). Usually the activity is expressed as CMCU per gram of enzyme protein (CMCU/g) or as a percentage of the activity that was originally added (CMCU %).

Results

The in-wash stability of the cellulases was determined as residual activity (in CMCU %) under the conditions indicated:

In detergent A:

| Time (min.) | E5 | E5cd | EGIII | KAC-500 | Cytolase 123 | Celluzyme |
|---|---|---|---|---|---|---|
| 1 | 100 | 100 | 100 | 100 | 100 | 100 |
| 5 | 100 | 100 | 95 | 66 | 93 | 100 |
| 10 | 101 | 93 | 90 | 47 | 88 | 102 |
| 15 | | 92 | 81 | 30 | 82 | 99 |
| 20 | 104 | 97 | 78 | 20 | 79 | 102 |
| 30 | 97 | 92 | 73 | 7 | 70 | 102 |
| 40 | 99 | 86 | 69 | 5 | 55 | 103 |

In detergent B:

| Time (min.) | E5 | E5cd | EGIII | KAC-500 | Cytolase 123 | Celluzyme |
|---|---|---|---|---|---|---|
| 1 | 100 | 100 | 100 | 38 | 100 | 100 |
| 5 | 100 | 101 | 89 | 4 | 95 | 100 |
| 10 | 81 | 101 | 83 | 3 | 86 | 88 |
| 15 | 111 | 101 | 72 | 1 | 80 | 79 |
| 20 | 100 | 103 | 64 | 2 | 81 | 75 |
| 30 | 108 | 103 | 54 | 2 | 72 | 68 |
| 40 | 95 | 101 | 47 | 2 | 69 | 58 |

EXAMPLE 2

Stability of cellulases in wash solutions in the presence of proteolytic enzyme

The in-wash stability of endoglucanases according to the invention was compared with several prior art cellulases in the presence of proteolytic enzyme, under the following conditions:

Enzymes

As in Example 1.

The protease tested was Savinase 6.0T a commercial enzyme ex. Novo Nordisk A/S.

Detergents

As in Example 1.

Experimental

Experiments are carried out in a two liter thermostatted vessel, containing 1 liter of artificially hardened water (16° FH., prepared with $CaCl_2$, $MgCl_2$, Ca:Mg ratio 4:1). the water reaches a temperature of 40° C., the detergent is added to a concentration of 4 g/l and 64.2 mg/l Savinase 6.0T. The cellulase is dosed after 5 minutes at a concentration of 8 mg enzyme protein per liter. Immediately after mixing a sample is taken (t=1). Between t=1 and t=40 minutes samples are taken. protease activity is immediately inhibited by addition of phenyl methyl sulphonyl fluoride (PMSF). For this a stock solution of 20 mg of PMSF (Merck catalogue number 7349) in 1 ml of ethanol is prepared. Of this stock 0.125 ml is added to 1 ml of sample. Then residual cellulase activity is measured as described in Example 1.

Results

The in-the-wash stability of the cellulases was determined as residual activity (in CMCU %) under the conditions indicated:

In detergent A+Savinase:

| Time (min.) | E5 | E5cd | EGIII | KAC-500 | Cytolase 123 | Celluzyme |
|---|---|---|---|---|---|---|
| 1 | 100 | 100 | 100 | 49 | 100 | 100 |
| 5 | 100 | 100 | 99 | 4 | 4 | 100 |
| 10 | 97 | 97 | 97 | 5 | 0 | 101 |
| 15 | 96 | 99 | 94 | 5 | 0 | 101 |
| 20 | 101 | 98 | n.d. | 3 | n.d. | 99 |
| 25 | n.d. | n.d. | 85 | n.d. | 0 | n.d. |
| 30 | 98 | 99 | n.d. | 0 | n.d. | 101 |
| 40 | 101 | 100 | 78 | 0 | 0 | 103 |

n.d. = not determined

In detergent B+Savinase:

| Time (min | E5 | E5cd | EGIII | Cytolase 123 |
|---|---|---|---|---|
| 1 | 100 | 100 | 100 | 100 |
| 5 | 100 | 100 | 94 | 7 |

-continued

| Time (min | E5 | E5cd | EGIII | Cytolase 123 |
|---|---|---|---|---|
| 10 | 102 | 112 | 85 | 7 |
| 15 | 93 | 104 | 75 | 7 |
| 20 | 91 | 104 | 66 | 6 |
| 30 | 89 | 103 | 56 | n.d. |
| 40 | 90 | 100 | 45 | n.d. |

n.d. = not determined

EXAMPLE 3

Stability of cellulases in wash solutions in the presence of bleach

The in-the-wash stability of endoglucanases according to the invention was compared with several prior art cellulases in the presence of bleach, under the following conditions:

Enzymes

As in Example 1.

Detergents

As in Example 1.

Experimental

Experiments are carried out in a two liter thermostatted vessel, containing 1 liter of artificially hardened water (16° FH., prepared with $CaCl_2$, $MgCl_2$, Ca:Mg ratio 4:1). When the water reaches a temperature of 40° C. the detergent B is added at 4 g/l and a dry mix of the bleach components giving a final concentration of 0.26 g/l TAED (83%)+0.82 g/l percarbonate IS0694+0.017 g/l Dequest 2047. The cellulase is dosed after 5 minutes at a concentration of 8 milligrams enzyme protein per liter. Immediately after mixing a sample is taken (t=1). Between t=1 and t=60 minutes samples are taken. 20 g/l sodium sulphite (Merck 6652) is added to each sample to reduce the bleach system. Then residual cellulase activity is measured as described in Example 1.

Results

The in-wash stability of the cellulases was determined as residual activity (in CMCU %) under the conditions indicated:

In detergent B+bleach:

| Time (min.) | E5 | E5cd | EGIII | Celluzyme |
|---|---|---|---|---|
| 1 | 100 | 100 | 100 | 100 |
| 5 | 100 | 100 | 96 | 89 |
| 10 | 100 | 98 | 81 | 79 |
| 15 | 91 | 102 | n.d. | n.d. |
| 20 | 87 | 97 | 54 | 60 |
| 30 | 101 | 94 | 34 | 48 |
| 40 | 91 | 95 | 21 | 43 |

n.d. = not determined

EXAMPLE 4

Stability of cellulases in wash solutions in the presence of bleach and proteolytic enzyme The in-wash stability of endoglucanases according to the invention was compared with that of several prior art cellulases, in the presence of bleach and proteolytic enzyme, under the following conditions:

Enzymes

As in Example 2.

Detergents

As in Example 1.

Experimental

Experiments are carried out in a two liter thermostatted vessel, containing 1 liter of artificially hardened water (16° FH., prepared with $CaCl_2$, $MgCl_2$, Ca:Mg ratio 4:1). When the water reaches a temperature of 40° C. the detergent B is added at 4 g/l then 64.2 mg/l Savinase 6.0T and a dry mix of the bleach components giving a final concentration of 0.26 g/l TAED (83%)+0.82 g/l percarbonate IS0694+0.017 g/l Dequest 2047. The cellulase is dosed after 5 minutes at a concentration of 8 milligrams enzyme protein per liter. Immediately after mixing a sample is taken (t=1). Between t=1 and t=60 minutes samples are taken. 20 g/l sodium sulphite (Merck 6652) is added to each sample to reduce the bleach system and 0.4 g/l trypsin inhibitor (Sigma T-9253) to inhibit the protease. Then residual cellulase activity is measured as described in Example 1.

Results

The in wash stability of the cellulases was determined as residual activity (in CMCU %) under the conditions indicated:

In detergent B+bleach+Savinase:

| Time (minutes) | E5 | E5cd | EGIII |
|---|---|---|---|
| 1 | 100 | 100 | 100 |
| 5 | 100 | 68 | 89 |
| 10 | 107 | 86 | 63 |
| 15 | 105 | 86 | n.d. |
| 20 | 100 | 83 | 19 |
| 30 | 98 | 86 | 6 |
| 40 | 93 | 80 | 4 |

n.d. = not determined

EXAMPLE 5

Stability of cellulases in wash solutions in the presence of lipase (and protease and or bleach)

Similar results as in shown in Examples 1,2,3 and 4 are obtained when 0.37% Lipolase 100L is present in detergent A and 0.25% Lipolase 100T is present in detergent B.

In detergent A+Lipolase:

| Time (minutes) | E5 | E5cd |
|---|---|---|
| 1 | 100 | 100 |
| 5 | 100 | 100 |
| 10 | 104 | 99 |
| 15 | 93 | 95 |
| 20 | 103 | 85 |
| 30 | 91 | 98 |
| 40 | 119 | 72 |

In detergent B+Lipolase:

| Time (minutes) | E5 | E5cd |
|---|---|---|
| 1 | 100 | 100 |
| 5 | 100 | 100 |
| 10 | 107 | 101 |
| 15 | 92 | 107 |
| 20 | 108 | 112 |
| 30 | 94 | 98 |
| 40 | 17 | 97 |

In detergent A+bleach+Savinase+Lipolase:

| Time (minutes) | E5cd |
|---|---|
| 1 | 100 |
| 5 | 100 |
| 10 | 100 |
| 15 | n.d. |
| 20 | 93 |
| 30 | 92 |
| 40 | 90 |
| 50 | 88 |
| 60 | 85 |

n.d. = not determined

In detergent B+bleach+Savinase+Lipolase:

| Time (minutes) | E5cd |
|---|---|
| 1 | 100 |
| 5 | 100 |
| 10 | 86 |
| 15 | 73 |
| 20 | 74 |
| 30 | 87 |
| 40 | 69 |

EXAMPLE 6

Depilling of cotton by cellulase

The potential of the cellulases of the invention to remove pills from a cotton fabric in multiple washes, is compared with that of several prior art cellulases.

Enzymes

As in Example 2, except that E5 was a preparation obtained from Alko Oy AB (Finland) and contained a mixture of E5 and E5cd. Celluzyme was dosed at 35 mg/l celluase protein, KAC-500 and EGIII were dosed at 35 mg/l endoglucanase protein and E5 was dosed at 35 mg/l E5 protein and 65 mg/l E5cd protein.

Detergent

Detergent C=powder detergent (pH 9.4):

| Component | % (w/w) |
|---|---|
| Linear PAS (Na salt of Coco alcohol derived sulphate) | 10.67 |
| Nonionic.3EO (Synperonic A3) | 4.55 |
| Nonionic.5EO (Synperonic A7) | 6.83 |
| Soap | 1.77 |
| Zeolite A24 | 36.8 |
| Sodium carbonate | 2.1 |
| Dequest 2047 | 0.0 |
| Sodium citrate 2aq. | 20.9 |
| Citric acid | 3.0 |
| SCMC | 1.0 |
| Antifoam granule | 4.0 |
| Water/salts | up to 100% |

Fabric

Cotton interlock was supplied scoured and bleached, but without optical whitener by phoenix Calico, Ashton-under-Lyme. The fabric possessed a definite "face" as one side had been raised during manufacture by light brushing. Further processing entailed jet-dying using Drimarene Brilliant Blue K-2R in the presence of 50 g/l Glauber's salt and 20 g/l soda ash followed by a hot rinse, soaping at the boil in the presence of 0.2 g/l Arkopan T and 0.5 g/l soda ash, two further rinses and stentor-drying. This cloth is further referred to as blue cotton interlock.

Prepilled cotton interlock

The blue cotton interlock was prepilled by washing 15 times in a Miele Automatic W 406 TMT washing machine for 30 minutes at 40° C. in demineralised water. After every 5 wash cycles fabrics were dried in a Miele Novotronic T440C tumble dryer (programma extra dry). Each machine load comprised six pieces of the interlock fabric (length 2 m, width 1.2 m) together with a dummy load of mixed cotton fabrics (terry, drill, sheeting) to bring the total mass of fabric in the drum up to 2.5 kg. After 15 wash cycles about 11 pills per square centimeter were visible on the fabric surface.

Calibration standards for pill score

Blue cotton interlock was prepilled as described above but using a variable number of wash cycles. Using image analyses a series of standards were prepared with an increasing number of pills. The increase in pilling for the standards was about linear with the scale number. Standards were scaled as 0,1,2,3,4 and 5, whereby 0 is untreated unpilled fabric and 5 is severely pilled fabric. Using this scale the above described, prepilled fabric would rank as 3.5.

Experimental

Prepilled blue cotton interlock was cut into pieces of 7.5*10 cm. Each piece of cloth was washed in 90 ml of detergent C (at 5 g/l in 16° FH. tap water, Ca:Mg=4:1) with or without cellulase (at 35 mg enzyme protein /l) in a 250 ml polyethylene bottle. 20 bottles were agitated simultaneously in a Miele Automatic W 406 TMT washing machine containing 2080 gram cotton dish cloth as ballast load. Bottles were agitated for 30 minutes at 40° C. Then the cloths were taken out of the bottles and rinsed in a bowl for 5 minutes in running tap water. The pH of residual suds after the wash was measured and found to be 9.2±0.2. Then cloths were dried in a Miele Novotronic T440C tumble dryer (extra dry). Then cloths were scored and washed again in the same detergent using the same protocol. The test continued until 10 wash/dry cycles.

Scoring procedure

The dry blue cotton was assessed by three separate persons. Each cloth had to be ranked using the above described scale. For each product 4 different test pieces were washed separately according to above described protocol. Results are presented as the average score for the 4 pieces as scored by the 3 panel members.

Result

In a comparative experiment the pill score of blue cotton interlock was measured for several cellulases using above described test conditions. Results are given versus the number of wash cycles.

| | Number of wash/dry cycles and pills scores | | | | | |
|---|---|---|---|---|---|---|
| Cellulase | 5 cycles | 6 cycles | 7 cycles | 8 cycles | 9 cycles | 10 cycles |
| No cellulase | 3.5 | 3.5 | 3.5 | 3.5 | 3.5 | 3.5 |
| KAC-500 | 3.3 | 3.3 | 3.3 | 3.3 | 3.3 | 3.3 |
| Celluzyme | 3.4 | 2.9 | 3.0 | 2.8 | 2.8 | 2.0 |
| E5 | 1.5 | 1.5 | 1.3 | 0.1 | 0.0 | 0.0 |
| EGIII | 2.9 | 3.0 | 3.1 | 3.3 | 3.4 | 3.4 |

EXAMPLE 7

Depilling in different detergents

Example 6 was repeated for E5, KAC-500 and Celluzyme using the following detergents at 4 g/l:

| Component | % (w/w) Detergent D (pH 10) | Detergent E (pH 10) |
|---|---|---|
| Linear PAS (Na salt of Coco alcohol derived sulphate) | 14.67 | 0.00 |
| Na-LAS (linear alkyl benzene sulphonate) | 0.00 | 20.14 |
| Nonionic.7EO (Synperonic A7) | 7.99 | 4.52 |
| Soap | 2.19 | 1.66 |
| Zeolite A24 | 29.27 | 35.13 |
| Sodium carbonate | 2.91 | 12.8 |
| Sodium bicarbonate | 0.00 | 3.82 |
| Dequest 2047 (33.5% A. I.) | 1.40 | 0.00 |
| Sodium citrate 2 aq. | 31.12 | 0.00 |
| Citric acid | 0.00 | 2.00 |
| SCMC | 0.87 | 0.60 |
| PVP | 0.00 | 0.47 |
| Polymer CP5 | 0.00 | 4.33 |
| Na-silicate | 0.00 | 0.47 |
| Savinase 6.0 T | 0.00 | 0.45 |
| Lipolase 100 T | 0.00 | 0.27 |
| Antifoam granule | 4.00 | 2.00 |
| Perfume | 0.00 | 0.36 |
| Water/salts | up to 100% | up to 100% |

Below, the results are given versus the number of wash cycles, for Detergent D:

| Cellulase | Number of wash/dry cycles and pills scores 5 | 6 | 7 | 8 | 9 | 10 |
|---|---|---|---|---|---|---|
| No cellulase | 3.5 | 3.5 | 3.5 | 3.5 | 3.5 | 3.5 |
| Celluzyme, 35 mg/l | 3.5 | 3.4 | 3.4 | 3.4 | 3.5 | 3.3 |
| KAC-500, 35 mg/l endoglucanase | 3.3 | 3.0 | 3.1 | 3.1 | 3.1 | 3.0 |
| 10 mg "E5"/l (3.5 mg/l E5 + 6.5 mg/l E5cd) | 3.5 | 3.3 | 2.8 | 2.6 | 2.6 | 2.6 |
| 30 mg "E5"/l (10 mg/l E5 + 20 mg/l E5cd) | 3.0 | 2.8 | 2.6 | 2.5 | 2.6 | 2.6 |
| 33 mg "E5"/l (7 mg/l E5 + 26 mg/l E5cd) | 3.0 | 2.9 | 2.9 | 2.6 | 2.6 | 2.5 |
| 109 mg "E5"/l (22 mg/l E5 + 87 mg/l E5cd) | 3.0 | 2.5 | 2.0 | 1.5 | 0.6 | 0.5 |

Below, the results are given versus the number of wash cycles, for Detergent E:

| Cellulase | Number of wash/dry cycles and pills scores 5 | 6 | 7 | 8 | 9 | 10 |
|---|---|---|---|---|---|---|
| No cellulase | 3.3 | 3.3 | 3.3 | 3.3 | 3.3 | 3.3 |
| Celluzyme, 35 mg/l | 3.5 | 3.5 | 3.4 | 3.1 | 3.1 | 3.0 |
| KAC-500, 35 mg/l endoglucanase | 3.5 | 3.1 | 3.0 | 3.3 | 3.3 | 3.1 |
| 10 mg "E5"/l (3.5 mg/l E5 + 6.5 mg/l E5cd) | 3.5 | 3.3 | 2.8 | 2.6 | 2.6 | 2.8 |
| 33 mg "E5"/l (7 mg/l E5 + 26 mg/l E5cd) | 3.0 | 2.9 | 2.9 | 2.9 | 2.9 | 2.9 |
| 109 mg "E5"/l (22 mg/l E5 + 87 mg/l E5cd) | 3.0 | 2.5 | 1.5 | 1.5 | 0.6 | 0.5 |

EXAMPLE 8

Storage stability in liquid detergents

The storage stability of the cellulases of the invention in liquid detergents was compared with that of several prior art cellulases.

Detergent

Detergent A of example 1 was supplemented with 0.31% Savinase 16.0 LDX+0.037% Lipolase 100L.

Detergent F=isotropic liquid detergent pH 7:

| Component | % (w./w) |
|---|---|
| Sodium Linear Alkylbenzene Sulfonate | 8.0 |
| Alcohol Ethoxylate.9EO | 8.0 |
| Sodium Alcohol EO Sulfate | 14.0 |
| Sodium Citrate | 5.0 |
| Propylene Glycol | 4.0 |
| Glycerol | 2.7 |
| Sorbitol | 4.5 |
| Sodium Tetraborate.$5H_2O$ | 3.05 |
| Savinase 16.0 L | 0.30 |
| Lipolase 100 L | 0.75 |
| Whitener | 0.15 |
| Opacifier | <0.1 |
| Preservative | <0.01 |
| Colorant | <0.01 |
| Perfume | 0.2 |
| Water | up to 100% |

Experimental

Enzymes were dosed in liquids A and F according to the levels outlined in the tables and were mixed by stirring over a period of 20 minutes. Each enzyme was added individually in the order of Savinase followed by Lipolase and cellulase. After mixing the liquids were split into smaller samples in closed containers and then stored at 37° C. At various time intervals samples were stored in a freezer at −20° C. prior to analysis. The residual cellulase activity was determined as described in Example 1.

Results

The residual cellulase activity (in CMCU %) after 4 weeks storage at 37° C.

| Cellulase | Amount of cellulase protein in liquid | Residual activity in detergent A 4 weeks 37° C. | Residual activity in detergent F 4 weeks 37° C. |
|---|---|---|---|
| E5 | 0.122 mg protein/g | 75 | 63 |
| EGIII | 0.122 mg protein/g | 33 | 0 |
| Celluzyme | 0.175 mg protein/g | 6 | 40 |

EXAMPLE 9

Depilling of cotton by cellulase in the presence of protease

Example 6 was repeated for detergent C to which a mixture of protease, lipase and amylase was added. Product dosage was 5 g/l, the pH of the wash solution was 9.0.

Enzymes

EGIII liquid was from Genencor, as described in example 1. It was dosed at two concentrations: 50 mg protein per liter wash solution and 89 mg/l.

Endoglucanase E5 derived from *Thermomonospora fusca* was obtained from prof. D. B. Wilson, Cornell University, 458 Biotechnology Building, Ithaca, N.Y., U.S.A. This sample of E5 was substantially pure and intact E5 enzyme as measured by SDS polyacrylamide gel electrophoresis. E5 was dosed at 50 mg/l.

Detergent

Composition of detergent C was the same as described in Example 6 with additional enzymes: 0.37% Savinase 12TX+0.17% Lipolase ultra 50T+0.05% Termamyl 60T.

These enzymes are commercial detergent enzymes sold by Novo Nordisk, Denmark.

Experimental

The experimental part was a repeat of Example 6 except that 3 instead of 4 different pieces of test cloth were washed for each product. Pill scores were made after each wash cycle by 3 panel members. Results are given as average score. A difference of 1 pill score unit is significant.

Results

| | Number of wash/dry cycles and pill scores | | | | | | | | | | |
|---|---|---|---|---|---|---|---|---|---|---|---|
| Cellulase | 0 cycles | 1 | 2 | 3 | 4 | 5 | 6 | 7 | 8 | 9 | 10 |
| No cellulase | 3.5 | 3.4 | 3.4 | 3.8 | 3.7 | 3.8 | 3.3 | 3.7 | 3.7 | 3.5 | 4.2 |
| EGIII 50 mg/l | 3.5 | 2.9 | 2.9 | 3.2 | 3.4 | 3.6 | 3.5 | 3.1 | 3.0 | 2.8 | 3.3 |
| EGIII 89 mg/l | 3.5 | 2.8 | 3.0 | 3.3 | 3.2 | 3.9 | 2.7 | 2.6 | 2.3 | 1.6 | 1.5 |
| E5 50 mg/l | 3.5 | 2.8 | 2.9 | 3.3 | 2.1 | 1.9 | 0.8 | 0.3 | 0 | 0 | 0 |

EXAMPLE 10

Depilling of cotton by cellulase in the presence of protease

Example 6 was repeated for detergent C to which a mixture of protease, lipase and amylase was added. product dosage was 5 g/l, the pH of the wash solution was 9.0.

Enzymes

EGIII liquid was from Genencor, as described in example 1. It was dosed at 89 mg protein per liter wash solution. Endoglucanase E5 derived from *Thermomonospora fusca* was obtained from Alko. This sample was stored for 19 months at 4° C. After storage the sample of E5 gave a single band on SDS polyacrylamide gel electrophoresis at a molecular weight of 32,000 kD. N-terminal sequencing gave an amino acid sequence of T-Q-P-G-T-G-T-P-V-E-R-Y-G-K-V. This sequence is identical to that of E5cd starting with amino acid Thr121 as published in Biochemistry 32, 8157–8161 (1993). E5cd obtained in this way was dosed at 50 mg/l, 150 mg/l and 250 mg protein per liter wash solution.

Detergent

Composition of detergent C was the same as described in Example 6 with additional enzymes: 0.37% Savinase 12TX+0.17% Lipolase ultra 50T+0.05% Termamyl 60T. These enzymes are commercial detergent enzymes sold by Novo Nordisk, Denmark.

Experimental

The experimemodi part was a repeat of example 6 with some modifications. 3 instead of 4 different pieces of test cloth were washed for each product. Size of the test cloths was 5 cm×5 cm. Each cloth was washed in 30 ml wash liquor in a 100 ml bottle. pill scores were made at the start and from the 5th wash onwards by 3 panel members. Results are given as average score.

Results

| | Number of wash/dry cycles and pill scores | | | | | | |
|---|---|---|---|---|---|---|---|
| Cellulase | start | 5 | 6 | 7 | 8 | 9 | 10 |
| No cellulase | 3.5 | 3.1 | 3.6 | 3.4 | 3.3 | 3.5 | 3.5 |
| EGIII 89 mg/l | 3.5 | 3.1 | 3.3 | 2.9 | 2.4 | 2 | 1.3 |
| E5cd 50 mg/l | 3.5 | 2.8 | 2.9 | 3.1 | 2.8 | 2.6 | 2.5 |
| E5cd 150 mg/l | 3.5 | 2.7 | 2.6 | 2.1 | 1.5 | 1.2 | 0.6 |
| E5cd 250 mg/l | 3.5 | 1.9 | 1.4 | 0.5 | 0.2 | 0.1 | 0.2 |

We claim:

1. An aqueous, isotropic liquid detergent composition comprising:

(a) 0.1% to 60% by weight of one or more surfactants;

(b) 0.06 to 600 CMCU per gram of said detergent composition of active endoglucanase E5 which is produced by *Thermomonospora fusca;* and (c) a proteolytic enzyme whereby the pH of a solution of 1 gram of the detergent composition in 1 liter of water with a hardness of 10° German before the addition of the detergent composition at 20° C., is in the range of 7 to 11.

2. An aqueous, isotropic liquid detergent composition according to claim 1 wherein said proteolytic enzyme is a subtilisin protease.

3. An aqueous, isotropic liquid detergent composition according to claim 1 which further comprises a bleaching agent.

* * * * *